US009056509B2

(12) United States Patent
Yamada

(10) Patent No.: US 9,056,509 B2
(45) Date of Patent: Jun. 16, 2015

(54) IMAGE RECORDING APPARATUS

(71) Applicant: SEIKO EPSON CORPORATION, Tokyo (JP)

(72) Inventor: Kentaro Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/341,242

(22) Filed: Jul. 25, 2014

(65) Prior Publication Data

US 2015/0077467 A1 Mar. 19, 2015

(30) Foreign Application Priority Data

Sep. 19, 2013 (JP) ..... 2013-194042

(51) Int. Cl.
*B41J 2/17* (2006.01)
*B41J 25/00* (2006.01)

(52) U.S. Cl.
CPC ..... *B41J 25/001* (2013.01)

(58) Field of Classification Search
None
See application file for complete search history.

(56) References Cited

U.S. PATENT DOCUMENTS 7,677,683 B2 * 3/2010 Iwakura ..... 347/8
8,474,945 B2 * 7/2013 Murray ..... 347/19
8,657,408 B2 * 2/2014 Ito et al. ..... 347/37
2009/0027446 A1 1/2009 Taira
2009/0284566 A1 11/2009 Suzuki et al.

FOREIGN PATENT DOCUMENTS

JP 2009-028975 A 2/2009
JP 2009-274285 A 11/2009
JP 2012-071472 A 4/2012

* cited by examiner

*Primary Examiner* — Lamson Nguyen
(74) *Attorney, Agent, or Firm* — Global IP Counselors, LLP

(57) ABSTRACT

There is provided a transporting section configured to transport a recording medium, a recording head configured to record an image on the recording medium, a carriage movable and holding the recording head, a first guide member guiding movement of the carriage, a second guide member guiding the movement of the carriage, a first movable member movable along with the carriage, a second movable member disposed away from the first movable member and movable along with the carriage, and a driving section configured to drive the carriage between a position where the recording head records the image onto the recording medium and a position where the recording head is separate from a path over which the transporting section transports the recording medium by moving the first movable member and the second movable member. The driving section moves the first movable member and the second movable member in synchronization.

7 Claims, 7 Drawing Sheets

IMAGE RECORDING APPARATUS

CROSS-REFERENCE TO RELATED APPLICATIONS

This application claims priority to Japanese Patent Application No. 2013-194042 filed on Sep. 19, 2013. The entire disclosure of Japanese Patent Application No. 2013-194042 is hereby incorporated herein by reference.

BACKGROUND

1. Technical Field

The present invention relates to an image recording apparatus which records an image onto a recording medium using a recording head, and in particular relates to a technique for moving a carriage which holds a recording head.

2. Related Art

An ink jet recording apparatus is known in the art that records an image by a recording head of an ink jet system being arranged to oppose a transport drum and ink being discharged from the recording head onto a recording sheet on the transport drum (see JP-A-2009-274285 (Patent Literature 1), for example). A maintenance unit is provided in the ink jet recording apparatus at a position which is separated from the transport drum and the recording head is able to be moved between a position of opposing the transport drum and a position of opposing the maintenance unit. Then, maintenance is carried out on the recording head at the position of opposing the maintenance unit while recording of images by the recording head is performed onto the recording sheets at the position of opposing the transport drum. At this time, movement of the recording head is performed by driving a head holder, which holds the recording head, using a linear motor or a rack and pinion.

SUMMARY

Here, it is possible to use guide members such as rails in order to guide the movement of a carriage such as a head holder. At this time, by providing the guide members with regard to both end sections of the carriage, guiding of the movement of the carriage using both end sections contributes to the stable movement of the carriage. However, when a force, which a driving mechanism such as a linear motor or a rack and pinion passes to the carriage, is applied to each of the guide members in an unbalanced manner, there are cases where the carriage is moved in a state where the carriage has an inclined posture. In this case, there is a concern that there will be an effect on image quality due to a reduction in positioning precision of the recording head which is held by the carriage.

The present invention is conceived in consideration of these circumstances. An advantage is to provide an image recording apparatus which records an image onto a recording medium using a recording head, with which it is possible to suppress a reduction in positioning precision of the recording head by appropriately moving a carriage which holds the recording head.

In order to achieve the advantage, an image recording apparatus according to an aspect of the invention is provided with a transporting section configured to transport a recording medium in a first direction, a recording head configured to record an image on the recording medium, a carriage movable in a second direction that intersects the first direction and holding the recording head, a first guide member guiding movement of the carriage in the second direction, a second guide member disposed away from the first guide member in the first direction, and guiding the movement of the carriage in the second direction, a first movable member movable in the second direction along with the carriage, a second movable member disposed away from the first movable member in the first direction, and movable in the second direction along with the carriage, and a driving section configured to drive the carriage between a position where the recording head records the image onto the recording medium and a position where the recording head is separate from a path over which the transporting section transports the recording medium in the second direction by moving the first movable member and the second movable member in the second direction. The driving section moves the first movable member and the second movable member in the second direction in synchronization.

In the aspect of the invention (the image recording apparatus) which is configured in this manner, the carriage which holds the recording head is provided so as to be able to move in the second direction which intersects with the first direction in which the recording medium is transported. Then, the movement of the carriage, which is in the second direction between the position where the recording head records the image onto the recording medium and the position where the recording head is separate from the path over which the transporting section transports the recording medium, is guided using the first guide member and the second guide member which are positioned to be separated in the first direction. In addition, the movement of the carriage is executed by the first movable member and the second movable member, which are positioned to be separated in the first direction, being moved along with the carriage. Moreover, the movement of the first and second movable members are performed in a state of being synchronized with each other. Accordingly, it is possible to comparatively balance the forces which are applied to the first and second guide members along with the movement of the carriage. As a result, it is possible to suppress a reduction in positioning precision of the recording head by appropriately moving the carriage which holds the recording head. That is, an example is given of a case where the first movable member and the second movable member are moved at the same speed (which includes a case of substantially the same speed) in directions parallel to each other (which is equivalent to the second direction) when exemplifying a case where the first movable member and the second movable member are shown to move in synchronization.

In addition, the image recording apparatus may be configured to have a first driving pulley, a second driving pulley disposed away from the first driving pulley in the first direction, and a linking member connecting the first driving pulley and the second driving pulley. The driving section includes a motor that is configured to rotate the first driving pulley. The first movable member includes a first belt that is wound onto the first driving pulley and rotates along with rotation of the first driving pulley. The second movable member includes a second belt that is wound onto the second driving pulley and rotates along with rotation of the second driving pulley.

With this configuration, the first driving pulley and the second driving pulley are positioned to be separated in the first direction. Then, the first belt and the second belt are wound onto the first driving pulley and the second driving pulley, and the first belt and the second belt function as the first movable member and the second movable member by being rotated along with the first driving pulley and the second driving pulley. Then, the motor which rotates the first driving pulley is provided, and the first driving pulley and the second driving pulley are connected using the linking member. With this configuration, the carriage is moved by the first and second belts which are wound onto the first and second driving pulleys rotating in synchronization with each other due to the first driving pulley and the second driving pulley rotating together when the motor rotates. As such, it is possible to comparatively balance forces which are applied to the first and second guide members along with the movement of the carriage. As a result, it is possible to suppress a reduction in positioning precision of the recording head by appropriately moving the carriage which holds the recording head.

In addition, the image recording apparatus may be configured so that the linking member is detachably attached to at least one of the first driving pulley and the second driving pulley.

With this configuration, it is possible to block transmitting of force between the first driving pulley and the second driving pulley by detaching the linking member. Accordingly, if the linking member is detached, it is possible to execute maintenance on the first belt and the second belt independently by eliminating the influence of the belts on one another. As such, operability of maintenance with regard to the first and second belts is improved.

In addition, the image recording apparatus may be configured to have a first driven pulley onto which the first belt is wound and that is driven by rotation of the first belt and a second driven pulley onto which the second belt is wound and that is driven by rotation of the second belt. Tension of the first belt is changeable by changing the position of the first driven pulley in the second direction and tension of the second belt is changeable by changing the position of the second driven pulley in the second direction.

With this configuration, it is possible to adjust the tension of the first belt by changing the position of the first driven pulley in the second direction and it is possible to adjust the tension of the second belt by changing the position of the second driven pulley in the second direction. Moreover, it is possible to block transmitting of force between the first driving pulley and the second driving pulley if the linking member is detached as described above. Accordingly, it is possible to execute changing of the tension of the first belt and adjusting of the tension of the second belt independently by eliminating the influence of the belts on one another. As such, operability of tension adjustment (maintenance) with regard to the first and second belts is improved.

In addition, the image recording apparatus may be configured so that the first and second belts include toothed belts, and the first and second driving pulleys include toothed pulleys.

With this configuration, there is an advantage in that it is possible to achieve space savings compared to, for example, a case such as where a rack and pinion is used. That is, in a case where a rack and pinion is used, it is necessary to secure a large space for movement of the rack in order for the rack which is the movable member to move in a straight line. In contrast to this, with a configuration where toothed belts and toothed pulleys are used, it is not necessary for a space which is as large as the space for movement of the rack to be secured as space for movement of the belts since the belts which are the movable members rotate and it is possible to achieve space savings.

BRIEF DESCRIPTION OF THE DRAWINGS

Referring now to the attached drawings which form a part of this original disclosure.

DETAILED DESCRIPTION OF EMBODIMENTS

Figure 1:
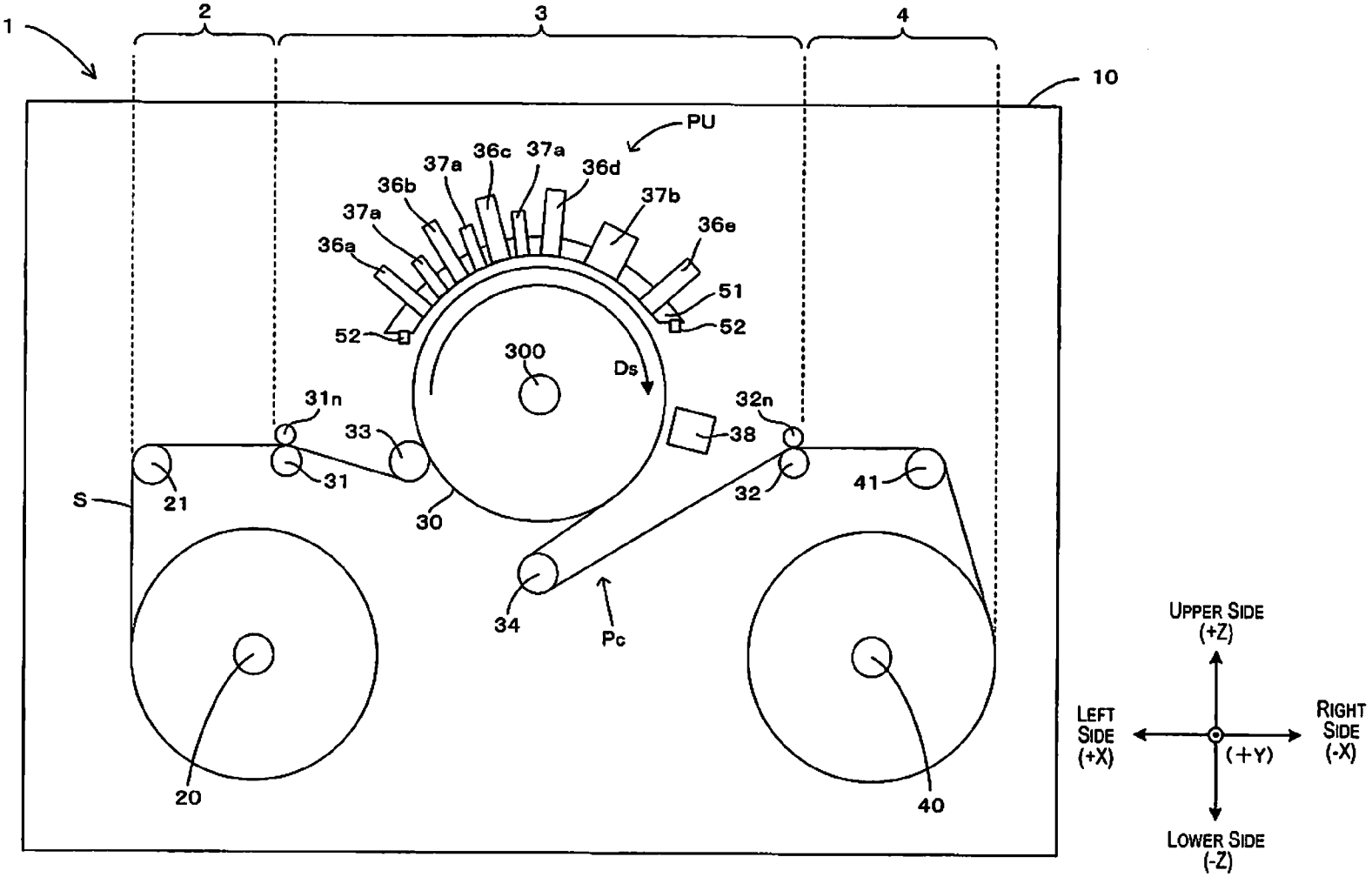
FIG. 1 is a front surface diagram schematically exemplifying an outline configuration of a printer where it is possible for the present invention to be applied.

FIG. 1 is a front surface diagram schematically exemplifying an outline configuration of a printer where it is possible for the present invention to be applied. Here, the XYZ orthogonal coordinates system, which correspond to a left and right direction X, a front and back direction Y, and a vertical direction Z of a printer 1, is shown in FIG. 1 and the other diagrams in order to clarify the arrangement relationships of each section of the apparatus as necessary.

As shown in FIG. 1, one sheet S (a wafer) which is wound around into a roll is stretched along a transport path Pc between a feeding shaft 20 and a winding shaft 40 at both ends in the printer 1, and the sheet S is transported in a transport direction Ds from the feeding shaft 20 toward the winding shaft 40 and image recording is carried out on the sheet S. It is possible for the classification of the sheets S to be divided into paper and film. To give specific examples, paper is high-quality paper, cast paper, art paper, coated paper, and the like and film is resin paper, PET (polyethylene terephthalate), PP (polypropylene), and the like. As an outline, the printer 1 is provided with a feeding section 2 (a feeding region) which feeds out the sheet S from the feeding shaft 20, a processing section 3 (a processing region) which records an image on the sheet S which is fed out from the feeding section 2, and a winding section 4 (a winding region) which winds in the sheet S, onto which an image is recorded by the processing section 3, onto the winding shaft 40, and the functional sections 2, 3, and 4 are accommodated in a housing member 10 to line up in the X direction. Here, in the following description, out of both surface of the sheet S, the surface where an image is recorded is a front surface and the surface on the opposite side is a rear surface.

The feeding section 2 has the feeding shaft 20 around which an end of the sheet S is wound and a driven roller 21 onto which the sheet S, which is drawn out from the feeding shaft 20, is wound. The feeding shaft 20 supports the end of the sheet S by being wound around in a state where the front surface of the sheet S faces toward the outside. Then, the sheet S, which is wound around the feeding shaft 20, is fed out to the processing section 3 through the driven roller 21 by the feeding shaft 20 being rotated in a clockwise direction on the surface of the paper in FIG. 1. That is, the sheet S is wound around the feeding shaft 20 via a core pipe (which is omitted from the diagram) which is able to be attached to and detached from the feeding shaft 20. Accordingly, it is possible to replace the sheet S on the feeding shaft 20 by mounting a new core pipe, where the sheet S is wound around into a roll, on the feeding shaft 20 when the sheet S on the feeding shaft 20 is used up.

The processing section 3 prints an image on the sheet S by the sheet S which is fed out from the feeding section 2 being supported by a rotating drum 30 and performing appropriate processing using a processing unit PU which is disposed along an outer circumference surface of the rotating drum 30. A front drive roller 31 and a rear drive roller 32 are provided in the processing section 3 on both sides of the rotating drum 30, and printing of the image is carried out by the sheet S, which is transported from the front drive roller 31 to the rear drive roller 32, being supported on the rotating drum 30.

The front drive roller 31 has a plurality of micro protrusions which are formed by thermal spraying on the outer circumference surface, and the sheet S, which is fed out from the feeding section 2, is wound onto the front drive roller 31 from the rear surface side. Then, the sheet S which is fed out from the feeding section 2 is transported to a downstream side of the transport path by the front drive roller 31 being rotated in a clockwise direction on the surface of the paper in FIG. 1. Here, a nip roller 31*n* is provided with regard to the front drive roller 31. The nip roller 31*n* impacts against the front surface of the sheet S in a state of being pressed to the front drive roller 31 side and the sheet S is pinched between the nip roller 31*n* and the front drive roller 31. Due to this, frictional force is maintained between the front drive roller 31 and the sheet S, and it is possible to reliably perform transporting of the sheet S using the front drive roller 31.

The rotating drum 30 is a drum with a cylindrical shape where a center line is parallel to the Y direction and the sheet S is wound onto the outer circumference surface of the rotating drum 30. Furthermore, the rotating drum 30 has a rotating shaft 300 which extends in an axial direction along the center line of the cylindrical shape of the rotating drum 30. The rotating shaft 300 is supported by a supporting mechanism, which is omitted from the diagram, to be able to rotate, and the rotating drum 30 rotates centered on the rotating shaft 300.

The sheet S, which is transported from the front drive roller 31 to the rear drive roller 32, is wound onto the outer circumference surface of the rotating drum 30 in this manner from the rear surface side. Then, the rotating drum 30 is driven and rotates in the transport direction Ds of the sheet S by receiving the frictional force between the rotating drum 30 and the sheet S, and the rotating drum 30 supports the sheet S from the rear surface side. That is, driven rollers 33 and 34, which fold back the sheet S at both sides of a section for winding onto the rotating drum 30, are provided in the processing section 3. Among these, the driven roller 33 folds back the sheet S by the front surface of the sheet S being wound onto between the front drive roller 31 and the rotating drum 30. On the other hand, the driven roller 34 folds back the sheet S by the front surface of the sheet S being wound onto between the rotating drum 30 and the rear drive roller 32. In this manner, it is possible to ensure that the section for winding onto the rotating drum 30 be long by the sheet S being folded back on each of the upstream side and the downstream side in the transport direction Ds with regard to the rotating drum 30.

The rear drive roller 32 has a plurality of micro protrusions which are formed by thermal spraying on the outer circumference surface, and the sheet S, which is transported from the rotating drum 30 through the driven roller 34, is wound onto the rear drive roller 32 from the rear surface side. Then, the sheet S is transported to the winding section 4 by the rear drive roller 32 being rotated in a clockwise direction on the surface of the paper in FIG. 1. Here, a nip roller 32*n* is provided with regard to the rear drive roller 32. The nip roller 32*n* impacts against the front surface of the sheet S in a state of being pressed to the rear drive roller 32 side, and the sheet S is pinched between the nip roller 32*n* and the rear drive roller 32. Due to this, frictional force between the rear drive roller 32 and the sheet S is maintained, and it is possible to reliably perform transporting of the sheet S using the rear drive roller 32.

In this manner, the sheet S, which is transported from the front drive roller 31 to the rear drive roller 32, is supported on the outer circumference surface of the rotating drum 30. In addition, the processing unit PU is provided in the processing section 3 in order to print a color image with regard to the front surface of the sheet S which is supported by the rotating drum 30. The processing unit PU is installed with a configuration where printing heads 36*a* to 36*e* and UV irradiating devices 37*a* and 37*b* are supported by a carriage 51.

Four of the printing heads 36*a* to 36*d* which are lined up in order in the transport direction Ds correspond to yellow, cyan, magenta, and black, and ink of the corresponding colors are discharged from nozzles using an ink jet system. Nozzle rows, where a plurality of nozzles are arranged in the Y direction across the width of the sheet S, are configured in each of the printing heads 36*a* to 36*d*, and ink is discharged from each of the nozzles in the nozzle rows. The four printing heads 36*a* to 36*d* are arranged in a radial formation from the rotating shaft 300 of the rotating drum 30 and line up along the outer circumference surface of the rotating drum 30. Then, each of the printing heads 36*a* to 36*d* are positionally aligned with regard to the rotating drum 30 using the carriage 51 and are opposed to the rotating drum 30 with a slight clearance (paper gap). Due to this, each of the printing heads 36*a* to 36*d* are opposed to the front surface of the sheet S which is wound onto the rotating drum 30 with a predetermined paper gap. In this manner, a color image is formed on the front surface of the sheet S by ink being landed on a desired position on the front surface of the sheet S by ink being discharged by each of the printing heads 36*a* to 36*d* in a state where the paper gap is regulated by the carriage 51. The image referred to here includes so-called complete covering where a recording region is completely covered with text or images in a single color.

UV (ultraviolet) ink (light curable ink) which is cured by irradiating ultraviolet rays (light) is used as the ink which is used by the printing heads 36*a* to 36*d*. Therefore, the UV irradiating devices 37*a* and 37*b* are provided in order to fix the ink to the sheet S by curing. Here, curing of ink is executed by being divided into two steps of provisional curing and complete curing. The UV irradiating devices 37*a* for provisional curing are disposed between each of the four printing heads 36*a* to 36*d*. That is, the UV irradiating devices 37*a* cure (provisionally cure) the ink by irradiating ultraviolet rays with a relatively low irradiation intensity to an extent where the wetting spread of the ink becomes sufficiently slow compared to a case where ultraviolet rays are not irradiated, and the ink is not completely cured. On the other hand, the UV irradiating device 37*b* for complete curing is provided on the downstream side in the transport direction Ds with regard to the four printing heads 36*a* to 36*d*. That is, the UV irradiating device 37*b* cures (completely cures) the ink by irradiating ultraviolet rays with an irradiation intensity which is higher than the UV irradiating devices 37*a* to an extent where the wetting spread of the ink is stopped. It is possible to fix the color image, which is formed by the plurality of printing heads 36*a* to 36*d*, to the front surface of the sheet S by execute provisional curing and complete curing in this manner.

Furthermore, the printing head 36*e* is provided on the downstream side in the transport direction Ds with regard to the UV irradiating device 37*b*. The printing head 36*e* discharges transparent UV ink from nozzles using an ink jet system. Nozzle rows, where a plurality of nozzles are arranged in the Y direction across the width of the sheet S, are configured in the printing head 36*e*, and ink is discharged from each of the nozzles in the nozzle rows. The printing head 36*e* is positionally aligned with regard to the rotating drum 30 using the carriage 51 and is opposed to the rotating drum 30 with a slight clearance (paper gap). Due to this, the printing head 36*e* is opposed to the front surface of the sheet S which is wound onto the rotating drum 30 with a predetermined paper gap. In this manner, a color image on the front surface of the sheet S is covered by a transparent ink by ink being landed on a desired position on the front surface of the sheet S by ink being discharged by the printing head 36*e* in a state where the paper gap is regulated by the carriage 51.

In this manner, the processing unit PU is configured by mounting the printing heads 36*a* to 36*e* and the UV irradiating devices 37*a* and 37*b* in the carriage 51. Here, guide rails 52 which extend in the Y direction are arranged to oppose both end sections of the carriage 51 in the X direction (the transport direction Ds) and the carriage 51 is spread across the two guide rails 52. Accordingly, the carriage 51 along with the printing heads 36*a* to 36*e* and the UV irradiating devices 37*a* and 37*b* is able to move on the guide rails 52 in the Y direction. Then, as will be described later using FIG. 2, the processing unit PU appropriately moves between a printing position Ta, an automatic maintenance position Tb, and a manual maintenance position Tc which line up in the Y direction.

Furthermore, a UV irradiating device 38 is provided in the processing section 3 on the downstream side in the transport direction Ds with regard to the printing head 36*e*. The UV irradiating device 38 completely cures the transparent ink which is discharged by the printing head 36*e* by irradiating ultraviolet rays with a high ultraviolet intensity. Due to this, it is possible to fix the transparent ink which covers the color image to the front surface of the sheet S.

The sheet S where the color image is formed by the processing section 3 is transported to the winding section 4 using the rear drive roller 32. The winding section 4 has a driven roller 41 onto which the sheet S is wound from the rear surface side between the winding shaft 40 and the rear drive roller 32 in addition to the winding shaft 40 around which the end of the sheet S is wound. The winding shaft 40 supports the end of the sheet S by winding in a state where the front surface of the sheet S faces toward the outside. That is, the winding shaft 40 winds in the sheet S which is transported from the rear drive roller 32 through the driven roller 41 when the winding shaft 40 rotates in a clockwise direction on the surface of the paper in FIG. 1. That is, the winding shaft 40 winds in the sheet S via the core pipe (which is omitted from the diagram) which is able to be attached to and detached from the winding shaft 40. Accordingly, it is possible to remove the sheet S from each core pipe when the sheet S which the winding shaft 40 winds in is at full capacity.

Figure 2:
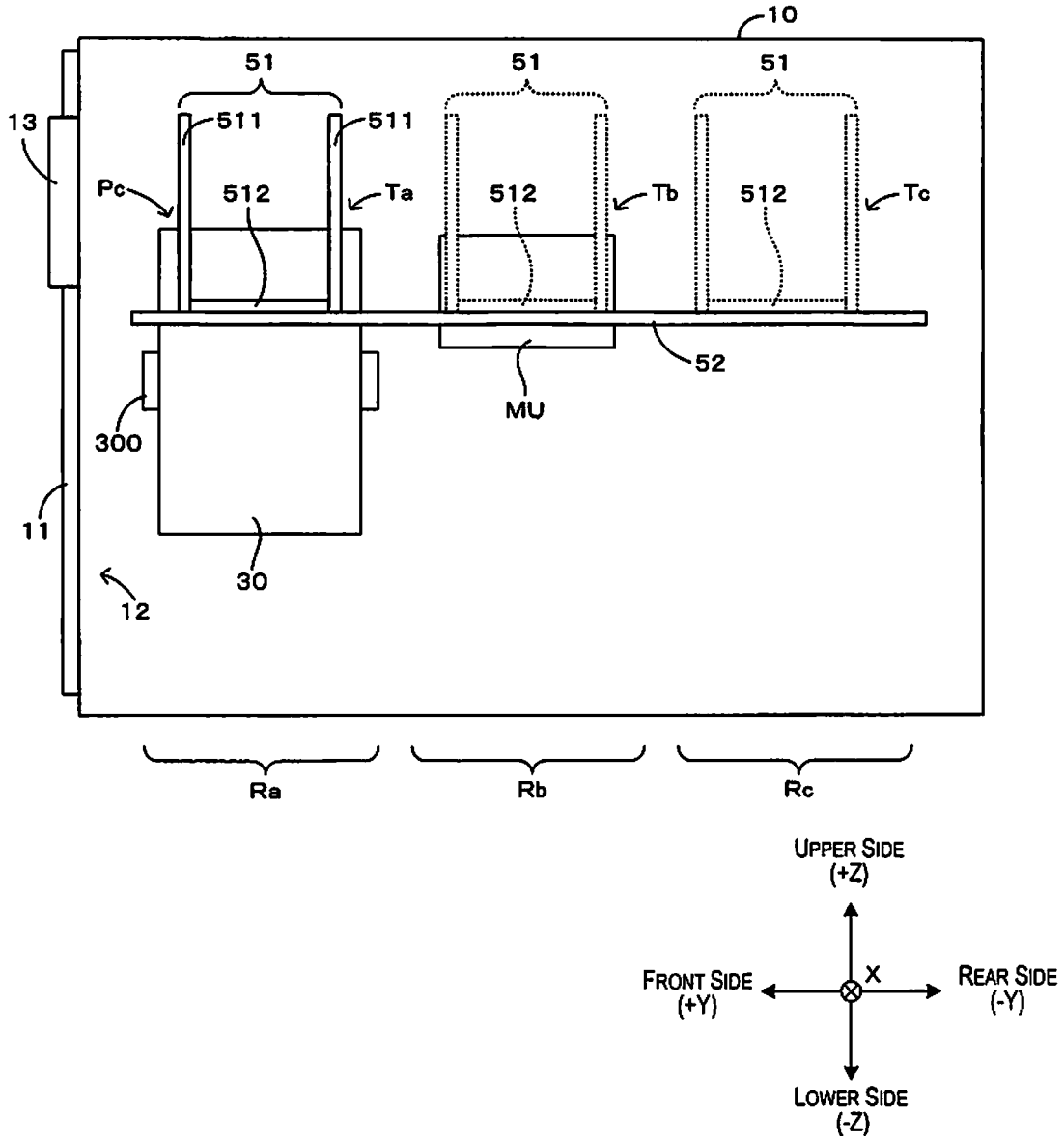
FIG. 2 is a side surface diagram schematically exemplifying an outline configuration of the printer which is shown in FIG. 1.

The above is an outline of the configuration of the printer 1 viewed from the front surface. Next, an outline of the configuration of the printer 1 viewed from the side surface will be described using FIG. 2. Here, FIG. 2 is a side surface diagram schematically exemplifying an outline configuration of the printer which is shown in FIG. 1. As shown in FIG. 2, the carriage 51 is configured by two support frames 511 which line up in the Y direction and a base frame 512 which connects the support frames 511 at a bottom end, and the printing heads 36*a* to 36*e* and the UV irradiating devices 37*a* and 37*b* are held by being interposed by the two support frames 511 in the Y direction. Here, in FIG. 2, the printing heads 36*a* to 36*e* and the UV irradiating devices 37*a* and 37*b* are omitted from the diagram, and out of the printing position Ta, the automatic maintenance position Tb, and the manual maintenance position Tc where the carriage 51 is positionally aligned in a selective manner, the carriage 51 in a case of being positioned at the printing position Ta is shown using a solid line and the carriage 51 in a case of being positioned at the automatic maintenance position Tb or the manual maintenance position Tc is shown using a dashed line.

A printing region Ra, an automatic maintenance region Rb, and a manual maintenance position Rc line up in the Y direction in a planar view at the inside of the housing member 10 of the printer 1. Printing on the sheet S is performed by accommodating each of the functional sections of the feeding section 2, the processing section 3, and the winding section 4 shown in FIG. 1 in the printing region Ra. Here, a front door 11 is provided on the front side (+Y side) of the housing member 10. The front door 11 is a door which opens and closes an opening section 12 which opens on the front side of the housing member 10, and it is possible to execute specific operations such as replacing the feeding shaft 20 or the winding shaft 40 or setting the sheet S on the rotating drum 30 by an operator accessing each of the functional sections at the printing region Ra through the opening section 12 in a state where the front door 11 is open. Furthermore, an operation section 13 is provided on the front side (+Y side) of the housing member 10 and it is possible for an operator to input various types of instructions into the printer 1 by operating the operation section 13.

Each of the printing position Ta, the automatic maintenance position Tb, and the manual maintenance position Tc are respectively provided in the printing region Ra, the automatic maintenance region Rb, and the manual maintenance position Rc. Then, it is possible for the carriage 51 to be positionally aligned at each of the positions Ta, Tb, and Tc in a selective manner by moving the carriage 51 along the two guide rails 52 on the right and left which extend across each of the positions Ta, Tb, and Tc which line up in the direction. In a case where the carriage 51 is positionally aligned at the printing position Pa, the printing heads 36*a* to 36*e* and the UV irradiating devices 37*a* and 37*b* oppose the transport path Pc of the sheet S. Accordingly, it is possible to perform printing of an image on the sheet S which is transported along the transport path Pc by performing discharging of ink from the printing heads 36*a* to 36*e* and irradiating of ultraviolet rays from the UV irradiating devices 37*a* and 37*b*. In addition, in a case where the carriage 51 is positionally aligned at the automatic maintenance position Tb or the manual maintenance position Tc, the printing heads 36*a* to 36*e* and the UV irradiating devices 37*a* and 37*b* retreat from the transport path PC of the sheet S in the −Y direction. Accordingly, it is possible to perform desired maintenance while preventing interference with the sheet S in the transport path Pc.

A maintenance unit MU is arranged below the automatic maintenance position Tb, and the printing heads 36*a* to 36*e* and the UV irradiating devices 37*a* and 37*b* oppose the maintenance unit MU from above in a state where the carriage 51 is positionally aligned at the automatic maintenance position Tb. The maintenance unit MU has a semi-cylindrical shape where the circular portion faces upward and the maintenance unit MU is adjacent to the rotating drum 30 in the Y direction in a state where the arc of the maintenance unit MU is positioned to match up with or slightly to the inner side with regard to the rotating drum 30 viewed from the Y direction. Then, the maintenance unit MU performs various types of maintenance such as capping, cleaning, and wiping with regard to the printing heads 36*a* to 36*e* which are mounted in the carriage 51 which is positioned at the automatic maintenance position Tb.

Capping is an action where a surface where the nozzle is open in the printing heads 36*a* to 36*e* (a nozzle forming surface) is covered by a cap which is installed in the maintenance unit MU. Due to the capping, it is possible to suppress increases in viscosity of ink inside the nozzles of the printing heads 36*a* to 36*e*. In addition, cleaning is an action where ink is forcibly discharged from the nozzles by the maintenance unit MU generating negative pressure in the cap in a state where the printing heads 36*a* to 36*e* are capped. Due to the cleaning, it is possible to remove ink where the viscosity has increased, bubbles in the ink, and the like from the nozzles. Wiping is an action where the nozzle forming surface of the printing heads 36*a* to 36*e* is wiped using a wiper which is installed in the maintenance unit MU. Due to the wiping, it is possible to wipe away ink from the nozzle forming surface of the printing heads 36*a* to 36*e*.

Below the manual maintenance position Tc is open and space for manual operations is secured below the printing heads 36*a* to 36*e* and the UV irradiating devices 37*a* and 37*b* in a state where the carriage 51 is positionally aligned at the manual maintenance position Tc. Accordingly, it is possible for an operator to execute maintenance, with regard to the printing heads 36*a* to 36*e* and the UV irradiating devices 37*a* and 37*b* which are mounted in the carriage 51 which is positionally aligned at the manual maintenance position Tc, by a manual operation such as wiping away ink using the space for manual operations.

Figure 3:
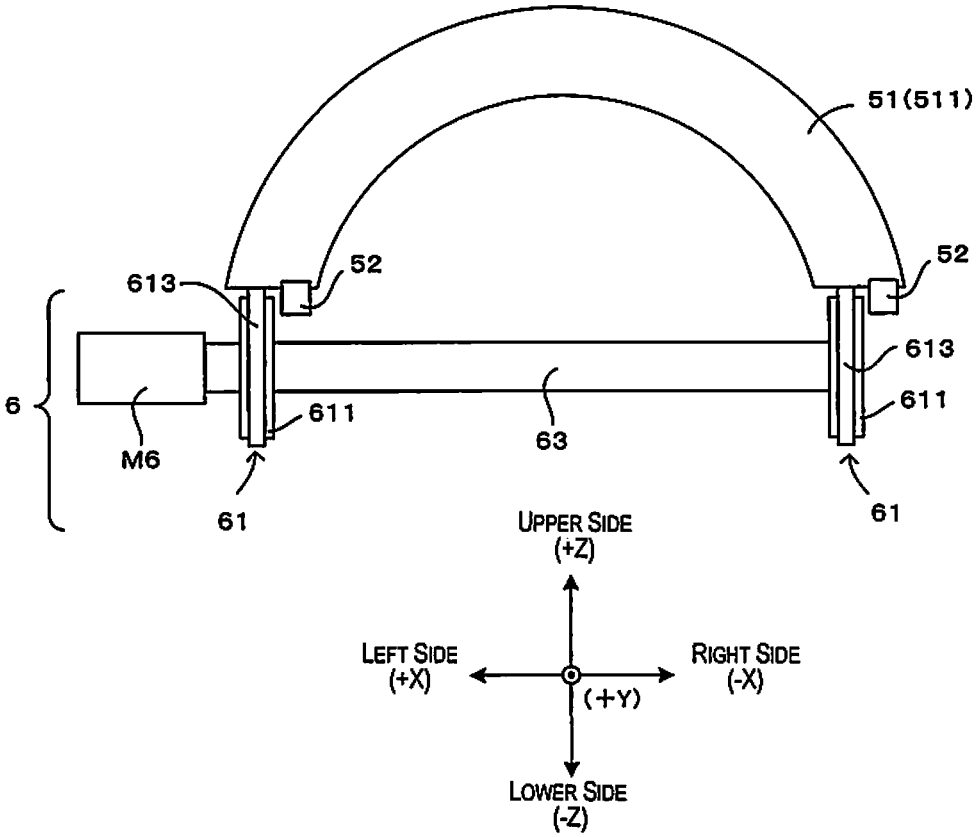
FIG. 3 is a front surface diagram schematically exemplifying a configuration of a driving mechanism and surrounding members which are provided in the printer.
Figure 4:
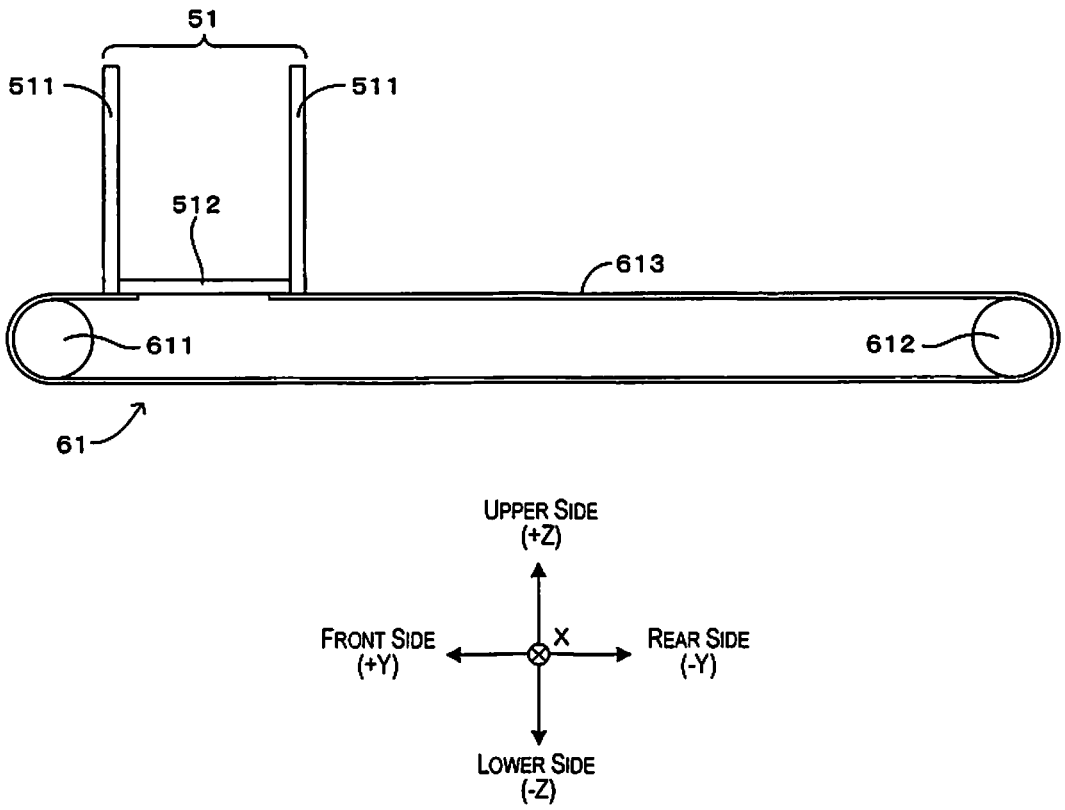
FIG. 4 is a side surface diagram schematically exemplifying a configuration of a driving mechanism and surrounding members which are provided in the printer.

Next, a driving mechanism which drives the carriage 51 in the Y direction will be described. FIG. 3 is a front surface diagram schematically exemplifying a configuration of a driving mechanism and surrounding members which are provided in the printer 1. FIG. 4 is a side surface diagram schematically exemplifying a configuration of a driving mechanism and surrounding members which are provided in the printer 1. Details of the guide rails 52 are omitted in FIG. 4. As described above, the carriage 51 is spread across the two guide rails 52, which are provided to oppose both end sections of the carriage 51 in the X direction (the transport direction Ds), and is able to move in the Y direction by being guided by the guide rails 52. Then, a driving mechanism 6 drives the carriage 51 in the Y direction along the guide rails 52.

In detail, the driving mechanism 6 has conveyors 61 which are configured by a driving pulley 611, a driven pulley 612, and a belt 613 which is spread across the pulleys 611 and 612. Each of the pulleys 611 and 612 is a toothed pulley which has a row of teeth where a plurality of teeth are lined up in a predetermined pitch and the belt 613 is a toothed belt which has a row of teeth where a plurality of teeth are lined up in a predetermined pitch. Then, the belt 613 is wound onto the pulleys 611 and 612 in a state where the teeth of each of the pulleys 611 and 612 mesh together with the teeth of the belt 613. Accordingly, when the driving pulley 611 is rotated, the belt 613 is rotated due to being driven by the driving pulley 611 and the driven pulley 612 is rotated due to being driven by the rotating of the belt 613. At this time, a portion where the belt 613 spans between the pulleys 611 and 612 moves along the front and back direction Y since the driving pulley 611 and the driven pulley 612 are arranged to line up in the front and back direction Y. In addition, both end sections of the belt 613 are fixed to the base frame 512 of the carriage 51. Accordingly, when the belt 613 is rotated due to being driven by the driving pulley 611, the carriage 51 moves in the Y direction along with the belt 613. The driving mechanism 6 is configured so that the conveyors 61 are respectively arranged on the left sides of each of the guide rails 52 in the Y direction and movement is possible in the front and back direction Y along the guide rails 52 which are adjacent to the belts 613 in each of the conveyors 61.

In addition, the driving mechanism 6 has a linking shaft 63 which extends in the Y direction, and the driving pulley 611 of the conveyor 61 which is provided to correspond to the left end section of the carriage 51 (the left side driving pulley 611) and the driving pulley 611 of the conveyor 61 which is provided to correspond to the right end section of the carriage 51 (the right side driving pulley 611) are connected to each other by the linking shaft 63. Accordingly, a force is transferred between the left side driving pulley 611 and the right side driving pulley 611 through the linking shaft 63 and the two driving pulleys 611 rotate in synchronization. Furthermore, the driving mechanism 6 has a motor M6 which drives the left side driving pulley 611 which is coupled with the linking shaft 63 and rotates the left side driving pulley 611 by rotating the linking shaft 63. Accordingly, by rotating the motor M6, it is possible to rotate each of the belts 613 which are wound onto the two respective driving pulleys 611 in synchronization. To describe in detail, the diameters of the two driving pulleys 611 are equal to each other and the arrangement pitches of the teeth in the rows of teeth in the two driving pulleys 611 are also equal to each other. In addition, the arrangement pitches of the teeth in the rows of teeth in the two belts 613 are also equal to each other. Accordingly, by rotating the motor M6, the rows of teeth which are provided in the two driving pulleys 611 move at speeds which are equal to each other and the two belts 613 move toward the same direction (the front and back direction Y) at speeds which are equal to each other. In relation to this, a case is considered where there is a speed error, which is caused by differences which are included in the driving pulleys 611, the belts 613, and the like (for example, differences in the arrangement pitch of the teeth in the rows of teeth), in the speeds of the belts 613, but it is not a problem when regarding the two belts 613 moving in synchronization if such a degree of speed error is able to be ignored in practice. In this manner, when the two belts 613 which are provided to correspond to the left and right end sections of the carriage 51 are rotated in synchronization, the carriage 51 moves in the Y direction along the guide rails 52 which are provided to correspond to the left and right end sections of the carriage 51 by receiving driving force which is transferred from each of the belts 613. In relation to this, the motor M6 positionally aligns the carriage 51 by rotating according to instructions which an operator inputs through the operation section 13 (FIG. 2). In addition, a deceleration device may be provided between the motor M6 and the linking shaft 63.

Figure 5:
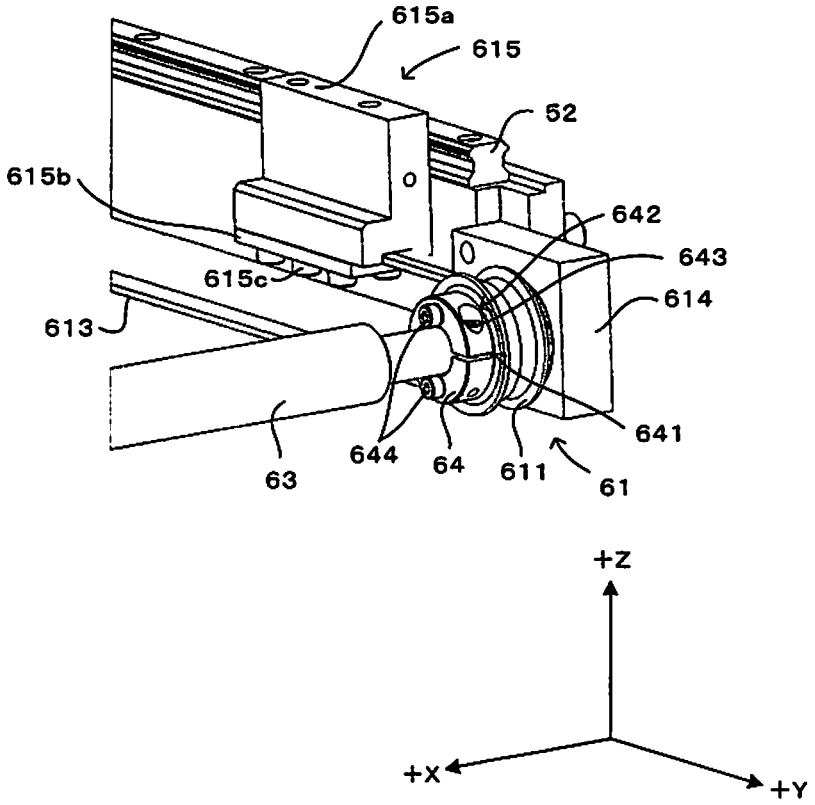
FIG. 5 is a perspective diagram schematically exemplifying a configuration of the surroundings of a driving pulley.

In addition, the belts 613 and the linking shaft 63 are configured to be able to be attached and detached with regard to the driving pulleys 611. Here, FIG. 5 is a perspective diagram exemplifying a partial configuration of the surroundings of the driving pulley, and in particular, exemplifies the configuration of the surroundings of the right side driving pulley 611. Here, since the configuration of the surroundings of the right side driving pulley 611 and the left side driving pulley 611 are substantially the same, the configuration of the surroundings of the right side driving pulley 611 will be described in detail here using FIG. 5.

As shown in FIG. 5, the linking shaft 63 passes through the driving pulley 611 and the linking shaft 63 is supported by a bearing member 614, which is provided with bearings, so as to be able to rotate. In addition, a spacer may be provided between the driving pulley 611 and the bearing member 614.

Then, a belt attaching member 615, which attaches the belt 613 which is wound onto the driving pulley 611 to the carriage 51, is arranged on the left side (+X side) of the guide rail 52. The belt attaching member 615 is configured by an upward member 615*a* which is fixed to the base frame 512 (FIG. 2 and FIG. 4) of the carriage 51, a downward member 615*b* which interposes the belt 613 from below with the upward member 615*a*, and a screw 615*c* which fastens together the upward member 615*a* and the downward member 615*b*. The attaching member 615 is provided to correspond to each of both end sections of the base frame 512 and it is possible to remove the belt 613 from the driving pulley 611 and the driven pulley 612 and replace the belt 613 by removing the downward members 615*b* of each of the attaching members 615 from the upward members 615*a*.

The driving pulley 611 and the linking shaft 63 are fastened together using a fastening member 64. The fastening member 64 is provided with a circular shape where a portion has been cut away and has a screw hole 642 which passes through in a cut away section 641. Then, it is possible to fix the fastening member 64 to the linking shaft 63, in a state where the linking shaft 63 is inserted into a hole which is in the center of the circular shape of the fastening member 64, by fastening a screw 643 which is inserted into the screw hole 642 due to the diameter of the hole which is in the center of the circular shape of the fastening member 64 becoming smaller as the gap with the cut away section 641 narrows. In addition, two screw holes which pass through in the X direction are provided in the fastening member 64 and it is possible to fix the fastening member 64 to the left side surface of the driving pulley 611 using screws 644 which are inserted into the screw holes. In this manner, it is possible to attach the linking shall 63 to the driving pulley 611. As the opposite of this, it is possible to detach the linking shaft 63 and the driving pulley 611 by detaching the fastening member 64 and the driving pulley 611 by removing the screw 643 or by detaching the fastening member 64 and the linking shaft 63 by removing the screws 644.

Figure 6:
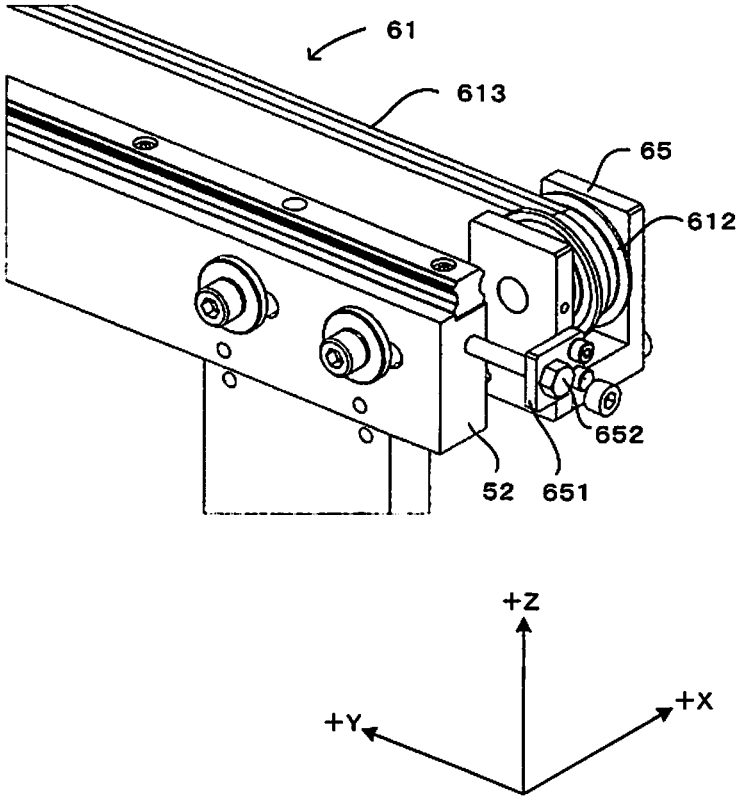
FIG. 6 is a perspective diagram schematically exemplifying a configuration of the surroundings of a driven pulley.

Furthermore, as shown in FIG. 6, it is possible to adjust the tension of the belt 613 which is provided in each of the conveyors 61 by adjusting the position of the driven pulley 612 in the Y direction. Here, FIG. 6 is a perspective diagram exemplifying a partial configuration of the surroundings of the driven pulley 612, and in particular, shows the configuration in the surroundings of the driven pulley 612 which is provided to correspond to the right end section of the carriage 51. Here, since the configurations of the surroundings of the driven pulleys 612 which are provided to correspond to both end sections of the carriage 51 are substantially the same, the configuration of the surroundings of the driven pulley 612, which is provided to correspond to the right end section of the carriage 51, will be described in detail here using FIG. 6.

As shown in FIG. 6, a pulley holder 65 is provided on the left side (+X side) of the guide rail 52, a rotating shaft passes through the driven pulley 612, and the driven pulley 612 is able to rotate with regard to the rotating shaft using bearings which are provided in the driven pulley 612. In addition, the rotating shaft is fixed to the pulley holder 65. In addition, a spacer may be provided between the driven pulley 612 and the pulley holder 65. A protrusion 651 which protrudes to the right side (−X side) is attached to the pulley holder 65, and the rear end of the guide rail 52 and the protrusion 651 are opposed in the Y direction. Then, a screw hole which extends in the Y direction is cut out from the protrusion 651 and a screw 652 is screwed into the screw hole. Accordingly, when the screw 652 is rotated, the pulley holder 65 is displaced in the Y direction with regard to the guide rail 52. In addition, the driven pulley 612 is displaced in the Y direction along with the displacement of the pulley holder 65 and the distance between the driven pulley 612 and the driving pulley 611 changes. As a result, the tension of the belt 613 which spans between the driven pulley 612 and the driving pulley 611 also changes. That is, it is possible to adjust the tension of the belt 613 by adjusting the position of the driven pulley 612 in the Y direction by appropriately rotating the screw 652.

Figure 7:
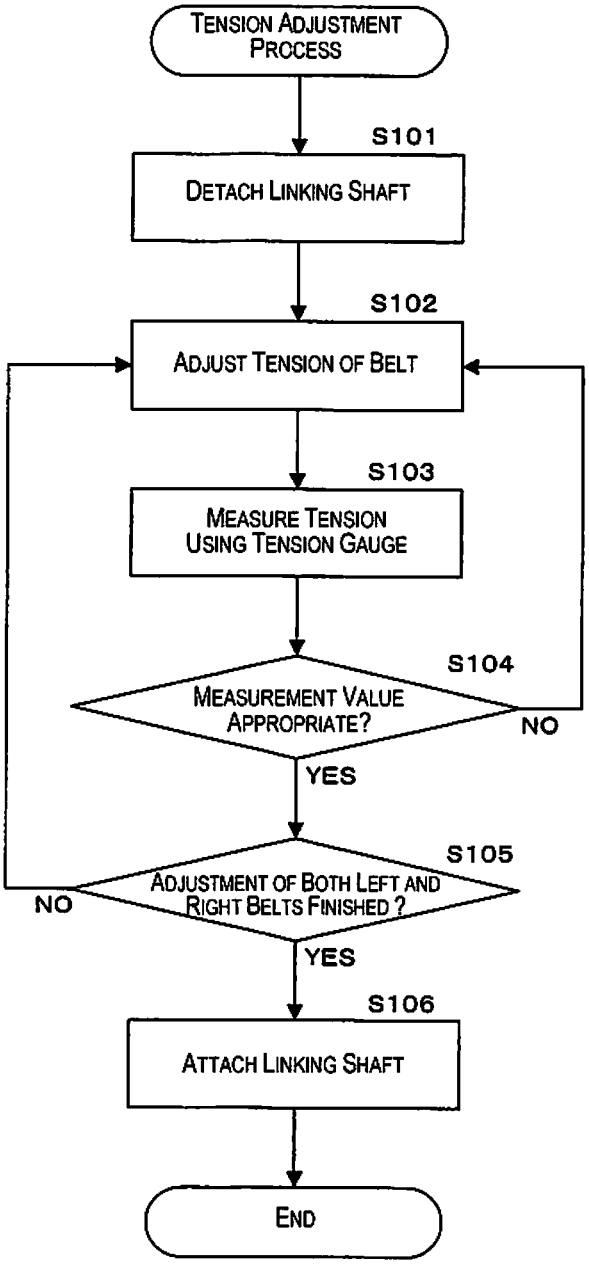
FIG. 7 is a flow chart illustrating an example of a belt tension adjustment process.

FIG. 7 is a flow chart illustrating an example of a belt tension adjustment process which is executed by an operator. In step S101, the operator detaches the linking shaft 63 from each of the driving pulleys 611. Next, in step S102, the operator adjusts the tension of the belts 613 which are wound onto the driven pulley 612 by adjusting the position of the driven pulleys 612 in the Y direction. Then, in step S103, the operator detects sound waves from the belts 613, which are vibrated at a natural frequency by strumming the belt 613 with a finger or the like, using a tension gauge and measures the tension of the belts 613. Then, in step S104, the operator determines whether or not the measurement values in step S103 are appropriate and repeats steps S102 to S104 until the measurement values express appropriate values. Then, the operator executes step S102 to step S104 until adjusting of the tension of the belts 613 on the left and right are finished (step S105) and attaches the linking shaft 63 to each of the driving pulleys 611 when tension adjustment is finished. In this manner, the tension adjustment process is completed for each of the belts 613.

In the embodiment which is configured in this manner, as described above, the movement of the carriage 51 in the Y direction between the printing position Ta, the automatic maintenance position Tb, and the manual maintenance position Tc is guided using each of the guide rails 52 which are provided to correspond to both end sections of the carriage 51 in the X direction (the transport direction Ds) which is orthogonal with the Y direction. In addition, the movement of the carriage 51 is executed by moving each of the belts 613, which are attached to the carriage 51 so as to respectively be adjacent to the guide rails 52, being moved in the Y direction. Moreover, the movement of each of the belts 613 is executed in synchronization with each other. Accordingly, it is possible to comparatively balance the forces which are applied to each of the guide rails 52 along with the movement of the carriage 51. As a result, it is possible to improve the positioning precision of the printing heads 36*a* to 36*e* in the Y direction by appropriately moving the carriage 51 which holds the printing heads 36*a* to 36*e* in the Y direction.

To describe in detail giving an example, in a case of a configuration where, for example, only the belt 613 which is provided with regard to one of the guide rails 52 is driven by the driving mechanism 6 (and the belt 613 is not provided at the other guide rail side), there is a tendency for the force which the driving mechanism 6 applies to the carriage 51 to be concentrated at the one guide rail 52. As a result, the carriage 51 is moved in the Y direction in a state of being inclined diagonally in the Y direction with the X direction as an axis. That is, an end section of the carriage 51 on the other guide rail 52 side is moved in the Y direction with a delay compared to an end section of the carriage 51 on the one guide rail 52 side. Then, the carriage 51 receives a force from the guide rails 52 which are provided at both ends at a stopping destination which is any of the positions Ta, Tb, or Tc, the carriage 51 is rotated with the X direction at the stopping position as the central axis, the rotation width is gradually narrowed, and the carriage 51 stops in a state where the X direction and the Y direction of the carriage 51 are respectfully parallel to the X direction and the Y direction. As a result, there is a concern that favorable printing is not possible with, for example, the positions of the printing heads 36*a* to 36*e* gradually displaced during printing along with the rotating of the carriage 51.

Alternatively, even in a case where each of the belts 613 which are provided at both of the guide rails 52 are driven by the driving mechanism 6, it is possible that the same circumstances as described above will be generated if the movement of each of the belts 613 is not in synchronization. In contrast to this, since both of the belts 613 on the left and right move in the Y direction in synchronization in the present embodiment, it is possible to comparatively balance the forces which are applied to each of the guide rails 52 along with the movement of the carriage 51. As a result, it is possible to improve the positioning precision of the printing heads 36*a* to 36*e* in the Y direction by appropriately moving the carriage 51 which holds the printing heads 36*a* to 36*e* in the Y direction.

In addition, the driving pulleys 611 are provided to be adjacent to the respective guide rails 52 which are provided to correspond to the left and right end sections of the carriage 51 in the present embodiment. Then, the belts 613 are wound onto the respective driving pulleys 611 on the left and right and the belts 613 on the left and right are rotated along with the respective driving pulleys 611 and move in the Y direction. Then, the motor M6 which rotates the left side driving pulley 611 is provided and each of the driving pulleys 611 on the left and right are connected to each other using the linking shaft 63. With this configuration, when the motor M6 is rotated, the carriage 51 is moved by the driving pulleys 611 on the left and right rotating together and each of the belts 613 which are wound onto the driving pulleys 611 on the left and right rotating in synchronization with each other. As such, it is possible to comparatively balance the forces which are applied to the guide rails 52 on the left and right along with the movement of the carriage 51. As a result, it is possible to improve the positioning precision of the printing heads 36*a* to 36*e* in the Y direction by appropriately moving the carriage 51 which holds the printing heads 36*a* to 36*e* in the Y direction.

In addition, it is possible to block transmitting of force between the driving pulleys 611 on the left and right by detaching the linking shaft 63. Accordingly, if the linking shaft 63 is detached, it is possible to execute maintenance on the belts 613 independently by eliminating the effect of the belts 613 on each other. As such, operability of maintenance with regard to the belts 613 is improved.

To describe in detail giving an example, it is possible to adjust the tensions of the belts 613 by adjusting the position of the driven pulleys 612 in the Y direction so as to be farther or closer with regard to the driving pulleys 611. Then, it is possible to execute this tension adjustment with regard to the belts 613 on the left and right. Moreover, as described above, it is possible to block transmitting of force between the driving pulleys 611 on the left and right if the linking shaft 63 is detached. Accordingly, the driving pulleys 611 rotate independently of each other without moving together. As a result, even when one of the driving pulleys 611 rotates with the belt 613 being displaced along with the tension adjustment of one of the belts 613, the other driving pulley 611 is not rotated and the tension of the belt 613 which is wound onto the other driving pulley 611 does not change. That is, it is possible to execute tension adjustment of the belts 613 on the left and right independently by eliminating the effect of the belts 613 on each other. As such, operability of tension adjustment (maintenance) with regard to each of the belts 613 on the left and right is improved.

In addition, in the present embodiment, the belts 613 are toothed belts and the driving pulleys 611 are toothed pulleys. With this configuration, there is an advantage in that it is possible to achieve space savings compared to, for example, a case such as where a rack and pinion is used. That is, in a case where a rack and pinion is used, it is necessary to secure a large space for movement of the rack in order for the rack which is the movable member to move in a straight line. In contrast to this, with a configuration where the toothed belts 613 and the toothed pulleys 611 are used, it is not necessary for a space which is as large as the space for movement of the rack to be secured as space for movement of the belts 613 since the belts 613 which are the movable members move by rotating and it is possible to achieve space savings.

In this manner, in the present embodiment, the printer 1 is equivalent to one example of the "image recording apparatus" of the present invention, the feeding shaft 20, the rollers 21, 31 to 34, and 41, the rotating drum 30, and the winding shaft 40 interacting function as one example of the "transporting section" of the present invention, the printing heads 36*a* to 36*e* are equivalent to one example of the "recording head" of the present invention, the carriage 51 is equivalent to one example of the "carriage" of the present invention, the guide rails 52 on the left and right are equivalent to one example of the "first guide rail" and the "second guide rail" of the present invention, the driving pulleys 611 on the left and right are equivalent to one example of the "first driving pulley" and the "second driving pulley" of the present invention, the driven pulleys 612 on the left and right are equivalent to one example of the "first driven pulley" and the "second driven pulley" of the present invention, the belts 613 on the left and right are equivalent to one example of the "first movable member" and the "second movable member" or the "first belt" and the "second belt" of the present invention, the linking shaft 63 is equivalent to one example of the "linking member" of the present invention, the motor M6 is equivalent to one example of the "driving section" or the "motor" of the present invention, the transport direction Ds is equivalent to one example of the "first direction" of the present invention, the front and back direction Y which is a direction which intersects with the transport direction Ds is equivalent to one example of the "second direction" of the present invention, the sheet S is equivalent to one example of the "recording medium" of the present invention, and the transport path Pc is equivalent to one example of the "path" of the present invention.

Here, the present invention is not limited to the embodiment described above and various modifications are possible with regard to the embodiment described above without departing from the gist of the present invention. For example, it is not necessary that the linking shaft 63 is able to be attached and detached with regard to both of the driving pulleys 611 on the left and right and the linking shaft 63 need only to be able to be attached and detached with regard to one of the driving pulleys 611. With this configuration, it is possible to perform tension adjustment of the belts 613 on the left and right independently by blocking transmitting of force between the driving pulleys 611 on the left and right.

In addition, it is not essentially necessary for the tension adjustment of the belt 613 on the left and right to be performed independently. Accordingly, it is not a problem if there is a configuration where the linking shaft 63 is not detached with regard to both of the driving pulleys 611 on the left and right.

In addition, it is not a problem if the linking shaft 63 is omitted. In this case, due to the motor M6 being provided with regard to each of the driving pulleys 611 on the left and right, each of the motors M6 may rotate in synchronization with each other.

In addition, the driving mechanism 6 in the embodiment described above is configured using the conveyors 61. However, it is not a problem if the driving mechanism 6 is configured using a configuration which is different to the conveyors 61 described above such as, to give specific examples, a linear motor, a rack and pinion, or the like.

In addition, an example is exemplified in the embodiment described above where the present invention is applied to the printer 1 which supports the sheet S using a drum with a cylindrical shape (the rotating drum 30). However, the specific configuration which supports the sheet S is not limited to this. Accordingly, it is not a problem if there is a configuration where the sheet S is supported on a flat surface of a support section with a plate shape.

In addition, it is possible to appropriately change the number of the printing heads 36*a* and 36*e* in addition to the arrangement, colors which are discharged, and the like. It is possible to appropriately change the number of the UV irradiating devices 37*a*, 37*b*, and 38 as well as the arrangement, ultraviolet ray intensity, and the like. Furthermore, appropriate modifications are possible with the formation for transporting of the sheet S and it is not a problem if there is a configuration such that the sheet S is transported by a formation other than roll-to-roll as described above.

In addition, the present invention is applied in the embodiment described above to the printer 1 which is provided with the printing heads 36*a* to 36*e* which discharge UV ink. However, it is not a problem if the present invention is applied with regard to a printer which is provided with a printing head which discharges an ink other than UV ink, for example, a water based ink such as a resin ink. Alternatively, it is not a problem if the present invention is applied with regard to a printer which performs printing using a substance other than ink such as toner.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. An image recording apparatus comprising:

a transporting section configured to transport a recording medium in a first direction;

a recording head configured to record an image on the recording medium;

a carriage movable in a second direction that intersects the first direction and holding the recording head;

a first guide member guiding movement of the carriage in the second direction;

a second guide member disposed away from the first guide member in the first direction, and guiding the movement of the carriage in the second direction;

a first movable member movable in the second direction along with the carriage;

a second movable member disposed away from the first movable member in the first direction, and movable in the second direction along with the carriage; and a driving section configured to drive the carriage between a position where the recording head records the image onto the recording medium and a position where the recording head is separate from a path over which the transporting section transports the recording medium in the second direction by moving the first movable member and the second movable member in the second direction, the driving section moving the first movable member and the second movable member in the second direction in synchronization.

2. The image recording apparatus according to claim 1, further comprising a first driving pulley, a second driving pulley disposed away from the first driving pulley in the first direction, and a linking member connecting the first driving pulley and the second driving pulley, the driving section including a motor that is configured to rotate the first driving pulley, the first movable member including a first belt that is wound onto the first driving pulley and rotates along with rotation of the first driving pulley, and the second movable member including a second belt that is wound onto the second driving pulley and rotates along with rotation of the second driving pulley.

3. The image recording apparatus according to claim 2, wherein the linking member is detachably attached to at least one of the first driving pulley and the second driving pulley.

4. The image recording apparatus according to claim 3, further comprising a first driven pulley onto which the first belt is wound, the first driven pulley being driven by rotation of the first belt, and a second driven pulley onto which the second belt is wound, the second driven pulley being driven by rotation of the second belt, tension of the first belt being changeable by changing position of the first driven pulley in the second direction, and tension of the second belt being changeable by changing position of the second driven pulley in the second direction.

5. The image recording apparatus according to claim 4, wherein the first and second belts include toothed belts, and the first and second driving pulleys include toothed pulleys.

6. The image recording apparatus according to claim 3, wherein the first and second belts include toothed belts, and the first and second driving pulleys include toothed pulleys.

7. The image recording apparatus according to claim 2, wherein the first and second belts include toothed belts, and the first and second driving pulleys include toothed pulleys.

* * * * *